US007946834B2

(12) United States Patent
Cho et al.

(10) Patent No.: US 7,946,834 B2
(45) Date of Patent: May 24, 2011

(54) BALANCE SHAFT MODULE EQUIPPED WITH OIL PUMP

(75) Inventors: Myung Rae Cho, Incheon (KR); Jin Woo Cho, Seongnam (KR); Woo Tae Kim, Suwon (KR); Hong Wook Lee, Yongin (KR); Min Sig Shin, Suwon (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 529 days.

(21) Appl. No.: 12/104,258

(22) Filed: Apr. 16, 2008

(65) Prior Publication Data

US 2009/0129959 A1 May 21, 2009

(30) Foreign Application Priority Data

Nov. 15, 2007 (KR) ..... 10-2007-0116621

(51) Int. Cl.
*F01C 21/00* (2006.01)
*F03C 2/00* (2006.01)

(52) U.S. Cl. ..... 418/151; 418/206.1; 418/206.3; 418/206.8; 417/902

(58) Field of Classification Search ..... 418/151, 418/206.1–206.8; 417/902
See application file for complete search history.

(56) References Cited

U.S. PATENT DOCUMENTS 4,132,513 A * 1/1979 Kulina ..... 418/151
4,174,195 A * 11/1979 Lassota ..... 418/151
4,431,387 A * 2/1984 Lassota ..... 417/902

FOREIGN PATENT DOCUMENTS

JP 2003-201912 A 7/2003

* cited by examiner

*Primary Examiner* — Theresa Trieu
(74) *Attorney, Agent, or Firm* — Morgan, Lewis & Bockius LLP

(57) ABSTRACT

A balance shaft module according to the present invention includes a first balance shaft equipped with a first eccentric balance weight, a second balance shaft equipped with a second eccentric balance weight, and a hydraulic pump that is operated by the first balance shaft and the second balance shaft, wherein the hydraulic pump includes a first gear equipped on the first balance shaft and a second gear equipped on the second balance shaft and externally meshed with the first gear.

5 Claims, 2 Drawing Sheets

BALANCE SHAFT MODULE EQUIPPED WITH OIL PUMP

CROSS-REFERENCE TO RELATED APPLICATION

This application claims priority to and the benefit of Korean Patent Application No. 10-2007-0116621 filed in the Korean Intellectual Property Office on Nov. 15, 2007, the entire contents of which are incorporated herein by reference.

BACKGROUND OF THE INVENTION (a) Field of the Invention

The present invention relates to a balance shaft module equipped with a hydraulic pump, particularly to a balance shaft module in which a hydraulic pump is formed as one body and thus a number of elements thereof are reduced to reduce cost.

(b) Description of the Related Art

All four-stroke reciprocating engines perform ignition at regular intervals to reduce vibrations of the engine. When a crank shaft of the engine rotates 720°, one cycle is completed, and ignition is performed at 180° intervals in an inline four-cylinder reciprocating engine. That is, when the crank shaft is rotated 180°, power is generated twice such that a second vibration occurs, which is more than a three cylinder or V-type engine. Therefore, two balance shafts that rotate in opposite directions and twice as fast as the crank shaft are required so as to reduce the second vibration.

The balance shaft module used for the inline four-cylinder engine reduces the second vibration of the engine. The balance shaft module is provided on the cylinder block or at a lower portion of the crank shaft adjacent to an oil pan of the engine.

The balance shaft module is composed of two shafts, and a driving sprocket is provided in one of the shafts. The driving sprocket is connected to the crank shaft by a gear or a chain. Further, the two shafts are connected by helical gears, and the two shafts rotate in opposite directions by way of the helical gears. Balance weights are respectively provided to the two shafts of the balance shaft module.

However, since in conventional arts, the balance shaft module and a hydraulic pump are separately provided, a number of parts of an engine and a manufacturing cost increase. In addition, there is a problem that noise and vibration occur when gears of the balance shaft are rotating in a meshed situation.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a balance shaft module having advantages of the hydraulic pump being formed integrally therewith, such that the number of parts of the engine and the manufacturing cost are reduced, and noise and vibration are reduced.

A balance shaft module according to an embodiment of the present invention may include: a first eccentric balance weight; a first balance shaft wherein the first eccentric balance weight is formed an end portion of the first balance shaft; a second eccentric balance weight; a second balance shaft positioned in parallel to the first balance shaft, wherein the second eccentric balance weight is formed an end portion of the second balance shaft; and a hydraulic pump having a first gear equipped on other end portion of the first balance shaft and a second gear equipped on other end portion of the second balance shaft wherein the first gear and the second gear are externally meshed to be engaged each other to rotate synchronously.

A first centroid of the first eccentric balance weight is configured to be distanced by a predetermined length from a center line of the first balance shaft and a second centroid of the second eccentric balance weight is configured to be distanced by a predetermined length from a center line of the second balance shaft.

Further the first centroid of the first eccentric balance weight and the second centroid of the second eccentric balance weight may be configured to have rotary phase offset of 180 degrees each other.

The first eccentric balance weight and the second eccentric balance weight may be configured to face each other symmetrically.

The hydraulic pump of the balance shaft module may include a pump housing in which the first gear and the second gear are installed in parallel therein, and oil is filled in the pump housing up to a predetermined height.

The predetermined height may be higher than a tooth engagement height at which teeth of the first gear and the second gear are engaged each other.

The hydraulic pump of the balance shaft module may have at least an inflow pipe connected to a lower portion of the pump housing and extends to a position that is higher than the predetermined height.

The hydraulic pump of the balance shaft module may have at least an outlet pipe connected to a upper portion of the pump housing, positioned higher than the predetermined height.

With the balance shaft module equipped with a hydraulic pump according to an exemplary embodiment of the present invention because the balance shaft module and the hydraulic pump are formed integrally, the number of parts of the engine and the assembling cost can be reduced. Further, since the gears are submerged in oil, abrasion and breakdown are prevented, and noise and vibration reduced.

The above features and advantages of the present invention will be apparent from or are set forth in more detail in the accompanying drawings, which are incorporated in and form a part of this specification, and the following Detailed Description of the Invention, which together serve to explain by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

DESCRIPTION OF REFERENCE NUMERALS INDICATING PRIMARY ELEMENTS IN THE DRAWINGS

Figure 1:
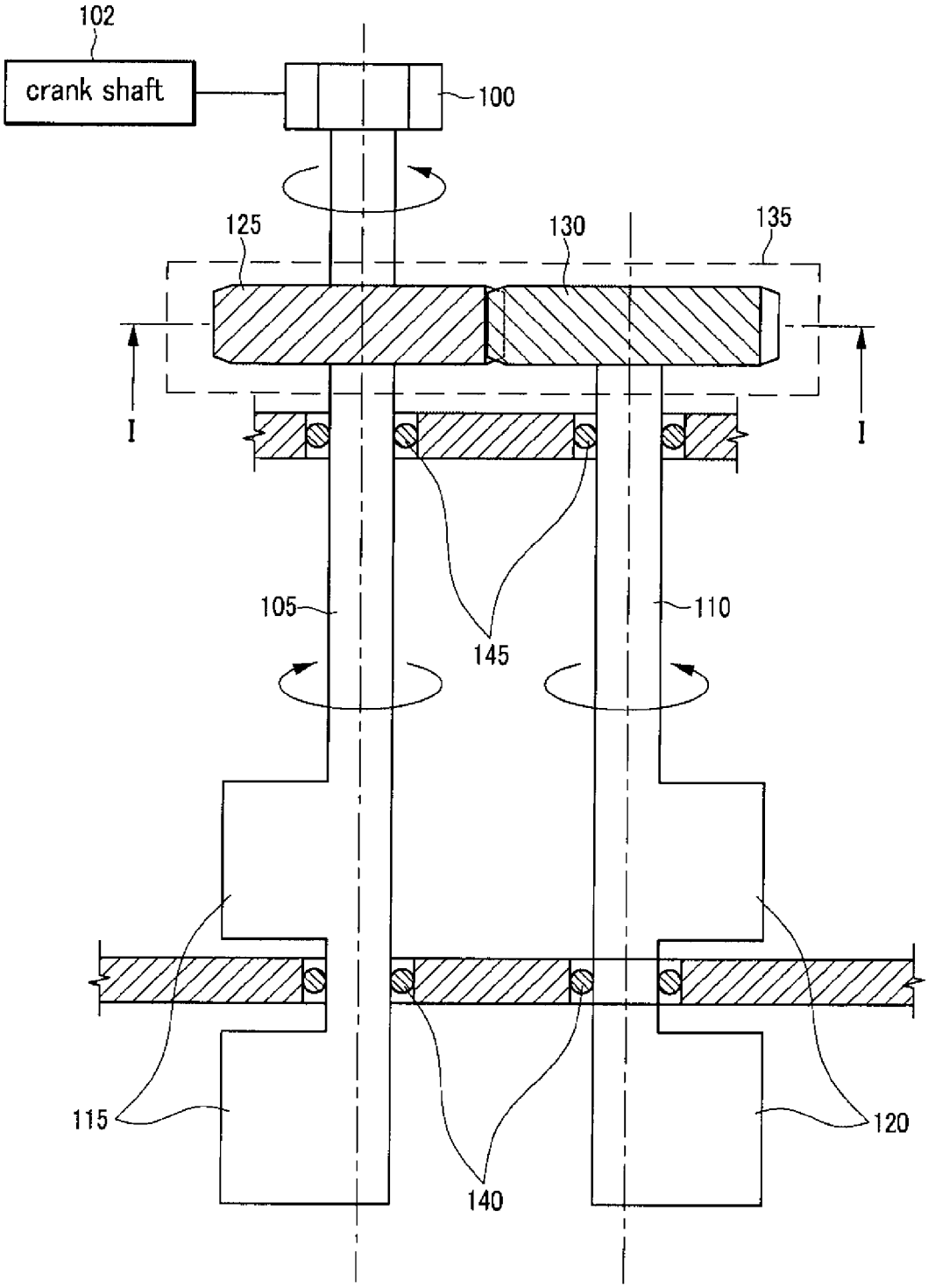
FIG. 1 is a top plan view of a balance shaft module according to an exemplary embodiment of the present invention.

| | |
|---|---|
| 100: sprocket | 102: crank shaft |
| 105: first balance shaft | 110: the second balance shaft |
| 115: first eccentric balance weight | 120: second eccentric balance weight |
| 125: first gear | 130: second gear |
| 135: hydraulic pump | 200: pump housing |
| 205: inlet | 210: outlet |

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

FIG. 1 is a top plan view of a balance shaft module according to an exemplary embodiment of the present invention.

Referring to FIG. 1, the balance shaft module (BSM) includes a sprocket 100, a first balance shaft 105, a second balance shaft 110, a first eccentric balance weight 115, a second eccentric balance weight 120, a first gear 125 and a second gear 130.

The sprocket 100 is provided in one end portion of the first balance shaft 105, and the sprocket 100 is coupled to the crank shaft 102 by a chain (not shown). In another embodiment of the present invention, rotation energy of the crank shaft 102 can be transferred to the first balance shaft 105 or the second balance shaft 110 by a gear (not shown) instead of the chain.

The first balance shaft 105 and the second balance shaft 110 are disposed parallel with each other, and supported by bearings 140 and 145 respectively.

Further, first eccentric balance weight 115 is provided at other end portion of the first balance shaft 105 that is opposite the end portion coupled to the sprocket 100, and the second eccentric balance weight 120 that corresponds symmetrically to the first eccentric balance weight 115 is provided to one end portion of the second balance shaft 110.

The first eccentric balance weight 115 and the second eccentric balance weight 120 are configured to have 180 degree of rotary phase offset each other as explained hereinafter.

The centroids of the first eccentric balance weight 115 and the second eccentric balance weight 120 are distanced from the center lines of the first and second balance shafts 105 and 110, respectively and configured to face each other symmetrically. The first eccentric balance weight 115 and the second eccentric balance weight 120 rotate in the opposite direction.

Accordingly, the balance shaft module of the present invention absorbs effectively vibration generated in the engine since vibratory force of the first balance shaft 105 may be canceled by vibratory force of the second balance shaft 110 occurring by the rotary phase offset of 180 degree with the first eccentric balance weight 115.

A flywheel (not shown) may be provided on the one end portion of the crank shaft 102 to absorb vibration generated in the engine, and a vibration damper (not shown) may also be installed. The vibration damper that is installed on an end portion of the crank shaft that is opposite to that of the flywheel protects against twisting of the crank shaft 102. The balance shaft module (BSM) does a similar function to the vibration damper.

Hereinafter, hydraulic pump 135 of the balance shaft module of the present invention as an exemplary embodiment will be explained in detail.

The first gear 125 that is adjacent to the sprocket 100 is coaxially installed on the first balance shaft 105, and the second gear 130 that corresponds to the first gear 125 is coaxially installed on other end portion of the second balance shaft 110. The first gear 125 and the second gear 130 are externally meshed. Accordingly, the first balance shaft 105 and the second balance shaft 110 rotate together synchronously.

The first gear 125 and the second gear 130 are precisely made to be engaged complementarily to rotate. As an exemplary embodiment of the present invention, the first gear 125 and the second gear 130 may have a helical gear structure.

Particularly, the first gear 125 and the second gear 130 are configured to pump oil in the present exemplary embodiment. Oil is to be supplied to some constituent elements of the engine (not shown). A separate hydraulic pump is not provided in the present exemplary embodiment as conventional arts but the balance shaft module functions as a hydraulic pump as explained hereinafter.

Figure 2:
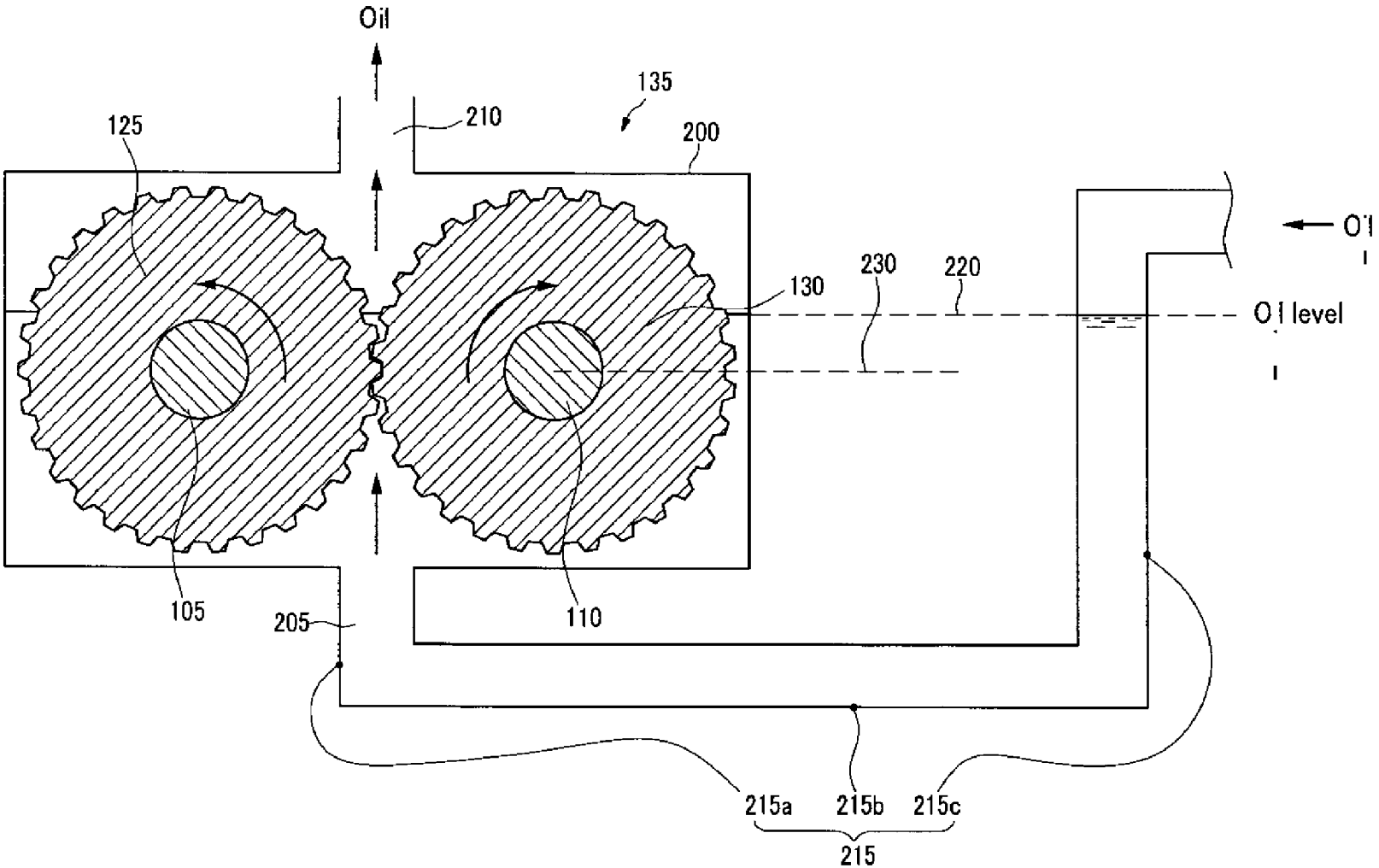
FIG. 2 is a cross-sectional view of a balance shaft module according to the I-I line of FIG. 1.

Since a general gear type of hydraulic pressure pump may operate by engaging two gears in one casing as an exemplary embodiment, the structure is simple and a valve for preventing back flow is not required as shown in FIG. 2.

FIG. 2 is a cross-sectional view of a balance shaft module according to the I-I line of FIG. 1.

Referring to FIG. 2, the balance shaft module includes a pump housing 200 and the first and second gears 125 and 130 are installed in parallel inside the pump housing 200.

An oil outlet 210 is formed at an upper portion of the pump housing 200, and an oil inlet 205 is formed at a lower portion of the pump housing 200. From the operation of the first and second gears 125 and 130, vacuum pressure is formed around the oil inlet 205 and thus the oil is pumped from the oil inlet 205 to the oil outlet 210 when the first gear 125 and the second gear 130 are rotating in complementary engagement.

Particularly, the oil is controlled to be filled in the pump housing 200 up to a predetermined height 220 higher than a tooth engagement height 230 in the present exemplary embodiment.

The tooth engagement height 230 is a level that teeth of the first gear 125 and the second gear 130 are engaged each other to transfer mechanical energy.

The tooth engagement height 230 is a critical factor for occurrence of noise and vibration since each time a gear tooth of the first gear 125 engages on the second gear 130, the teeth collide and this impact makes a lot of noise and vibration.

Accordingly the engaging teeth of the first gear 125 and the second gear 130 are better to be submerged into the oil which absorbs the noise and vibration caused by said engaging teeth. That is, as an illustrative embodiment of the present invention, the predetermined height 220 of the oil in the pump housing 200 is configured to be higher than the tooth engagement height 230 as shown in FIG. 2.

Referring to FIG. 2 again, more particularly an oil supply pipe 215 is provided to the pump housing 200, wherein the oil supply pipe 215 includes a first pipe 215*a*, a second pipe 215*b* and a third pipe 215*c*.

One end portion of the first pipe 215*a* is connected directly to the oil inlet 205 formed on the lower portion of the pump housing 200 and extends in a downward direction, and one end portion of the second pipe 215*b* is connected to other end portion of the first pipe 215*a* and extends in a horizontal direction. Further, one end portion of the third pipe 215 is connected to the other end portion of the second pipe 215*b* and extends in an upward direction.

The third pipe 215*c* extends to a position higher than the predetermined height 220. Accordingly, the oil is filled in the oil supply pipe 215 and the pump housing 200 up to the predetermined height 220 higher than the tooth engagement height 230.

As described above, since the oil is filled in the pump housing 200 to the predetermined height 220 higher than the tooth engagement height 230, parts of the first gear 125 and the second gear 130 are submerged in the oil and thus the noise and vibration is reduced by the oil when the first gear 125 and the second gear 130 are rotating synchronously. In addition, since the first gear 125 and the second gear 130 are always lubricated by the oil, abrasion and friction are prevented.

In another embodiment of the present invention, the oil inlet 205 and the oil outlet 210 can be formed in a side face of the pump housing 200 and the inlet 205 is positioned lower than the outlet 210.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A balance shaft module comprising:

a first eccentric balance weight;

a first balance shaft wherein the first eccentric balance weight is formed an end portion of the first balance shaft;

a second eccentric balance weight;

a second balance shaft positioned in parallel to the first balance shaft, wherein the second eccentric balance weight is formed an end portion of the second balance shaft; and a hydraulic pump having a first gear equipped on other end portion of the first balance shaft, and a second gear equipped on other end portion of the second balance shaft wherein the first gear and the second gear are externally meshed to be engaged each other to rotate synchronously;

wherein a first centroid of the first eccentric balance weight is configured to be distanced by a predetermined length from a center line of the first balance shaft and a second centroid of the second eccentric balance weight is configured to be distanced by a predetermined length from a center line of the second balance shaft;

wherein the first centroid of the first eccentric balance weight and the second centroid of the second eccentric balance weight are configured to have rotary phase offset of 180 degrees; and wherein the first eccentric balance weight and the second eccentric balance weight are configured to face each other symmetrically.

2. The balance shaft module of claim 1, wherein the hydraulic pump further includes a pump housing in which the first gear and the second gear are installed in parallel therein, and oil is filled in the pump housing up to a predetermined height.

3. The balance shaft module of claim 2, wherein the predetermined height is higher than a tooth engagement height at which teeth of the first gear and the second gear are engaged each other.

4. The balance shaft module of claim 3, wherein at least an inflow pipe is connected to a lower portion of the pump housing and extends to a position that is higher than the predetermined height.

5. The balance shaft module of claim 4, wherein at least an outlet pipe connected to a upper portion of the pump housing, positioned higher than the predetermined height.

* * * * *